US009101187B2

(12) United States Patent
Zheng

(10) Patent No.: US 9,101,187 B2
(45) Date of Patent: Aug. 11, 2015

(54) PORTABLE ORGANIZER FOR USE WITH LUGGAGE

(71) Applicant: Patent Category Corp., Walnut, CA (US)

(72) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 216 days.

(21) Appl. No.: 13/773,823

(22) Filed: Feb. 22, 2013

(65) Prior Publication Data

US 2014/0238802 A1 Aug. 28, 2014

(51) Int. Cl.

| | |
|---|---|
| ***A45C 7/02*** | (2006.01) |
| ***A45C 9/00*** | (2006.01) |
| *A45C 3/00* | (2006.01) |
| *A45C 13/02* | (2006.01) |

(52) U.S. Cl.

CPC ... *A45C 7/02* (2013.01); *A45C 9/00* (2013.01); *A45C 2003/002* (2013.01); *A45C 2013/026* (2013.01)

(58) Field of Classification Search

CPC ..... A45C 7/02; A45C 9/00; A45C 2013/026; A45C 2003/022

USPC ..... 220/9.2; 190/16–17, 108–110, 903, 190/113–114, 119, 13 C, 14, 124–127

See application file for complete search history.

(56) References Cited

U.S. PATENT DOCUMENTS

| | | | | |
|---|---|---|---|---|
| 607,539 | A * | 7/1898 | Camp | 190/17 |
| 2,126,206 | A * | 8/1938 | Plotkin | 190/109 |
| 3,410,328 | A * | 11/1968 | Sasai | 220/9.2 |
| 5,150,776 | A | 9/1992 | Rebenack | |
| 5,894,914 | A * | 4/1999 | Jubin | 190/119 |
| 7,681,728 | B2 * | 3/2010 | Sabounjian | 206/278.1 |
| 7,832,533 | B2 * | 11/2010 | Selvi | 190/124 |
| 2005/0121275 | A1 * | 6/2005 | Platte, III | 190/103 |
| 2005/0126872 | A1 * | 6/2005 | Dror | 190/107 |
| 2006/0096821 | A1 * | 5/2006 | McKaba | 190/9 |
| 2007/0295570 | A1 * | 12/2007 | Campbell et al. | 190/15 R |
| 2010/0276241 | A1 * | 11/2010 | Malone | 190/9 |

OTHER PUBLICATIONS

Shelves to Go, LLC.

* cited by examiner

*Primary Examiner* — Tri Mai
(74) *Attorney, Agent, or Firm* — Raymond Sun

(57) ABSTRACT

A travel case assembly has a travel case having a plurality of walls defining an enclosed storage space, and an organizer positioned inside the storage space. The organizer includes an enclosing netted fabric wall and netted fabric shelves that define at least one storage compartment, and a collapsible support system supporting and defining the netted fabric wall and netted fabric shelves so that (i) the compartments can be expanded when the shelves are separated from each other, and (ii) the shelves can be stacked into a compressed position.

10 Claims, 4 Drawing Sheets

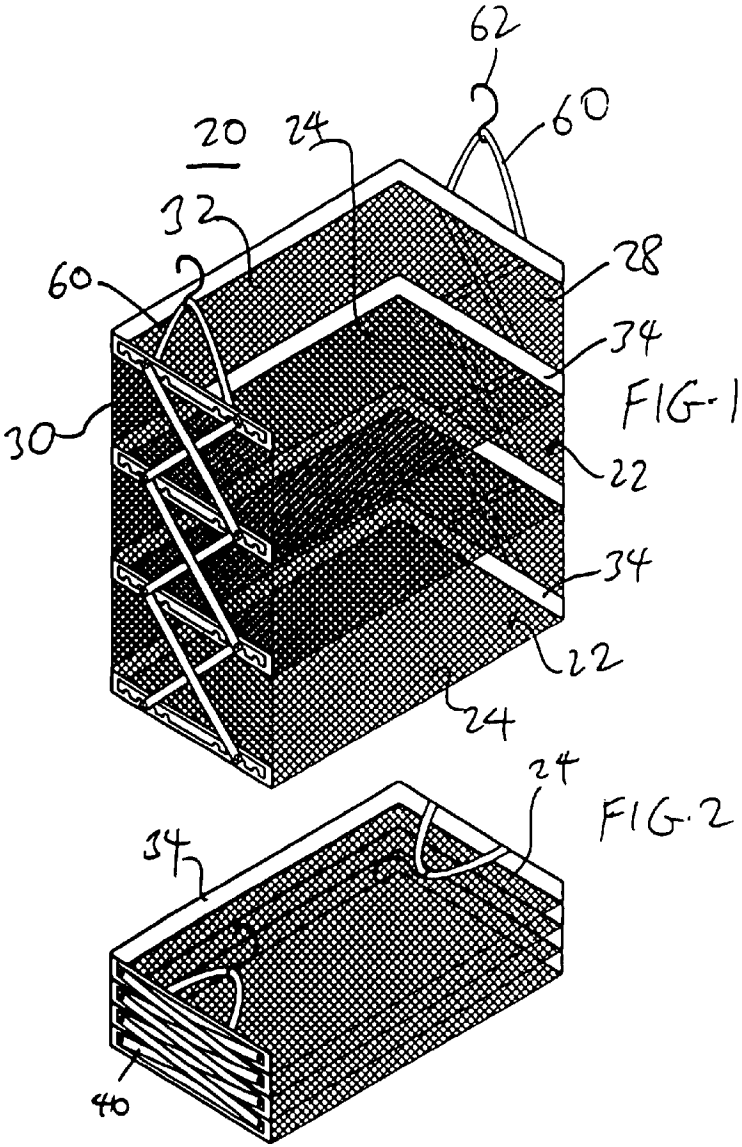
FIG. 1
FIG. 2
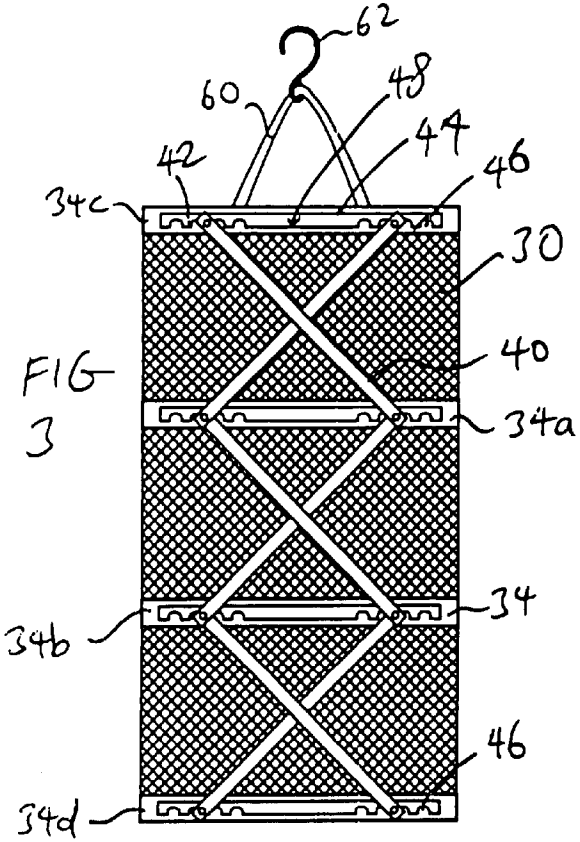
FIG 3
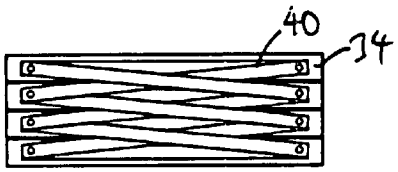
FIG 4

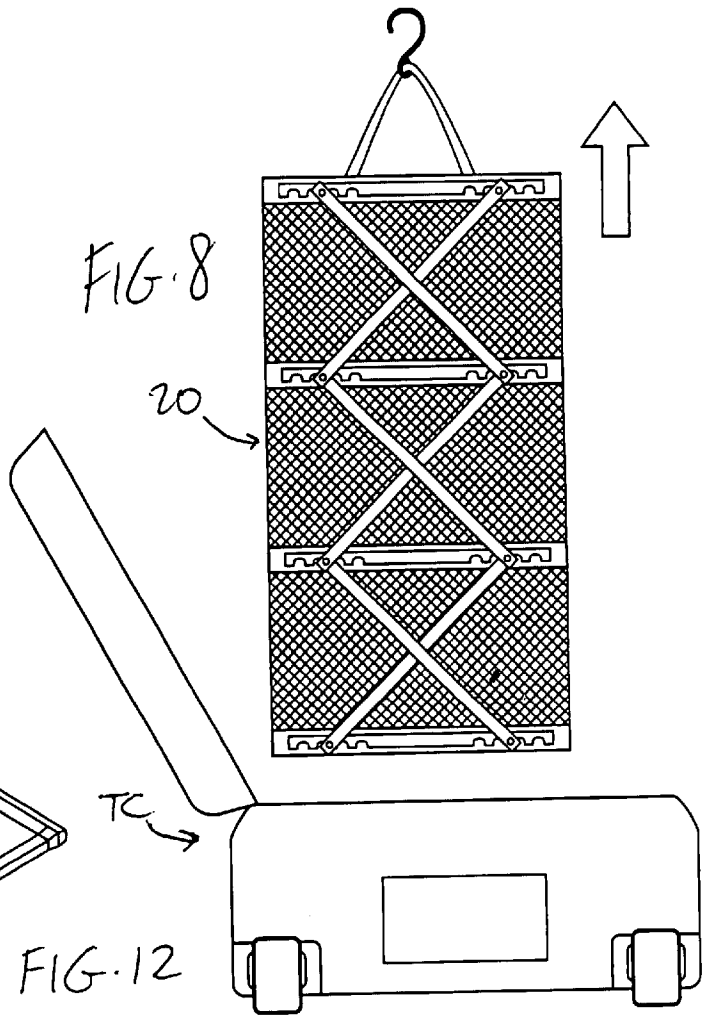
FIG. 8
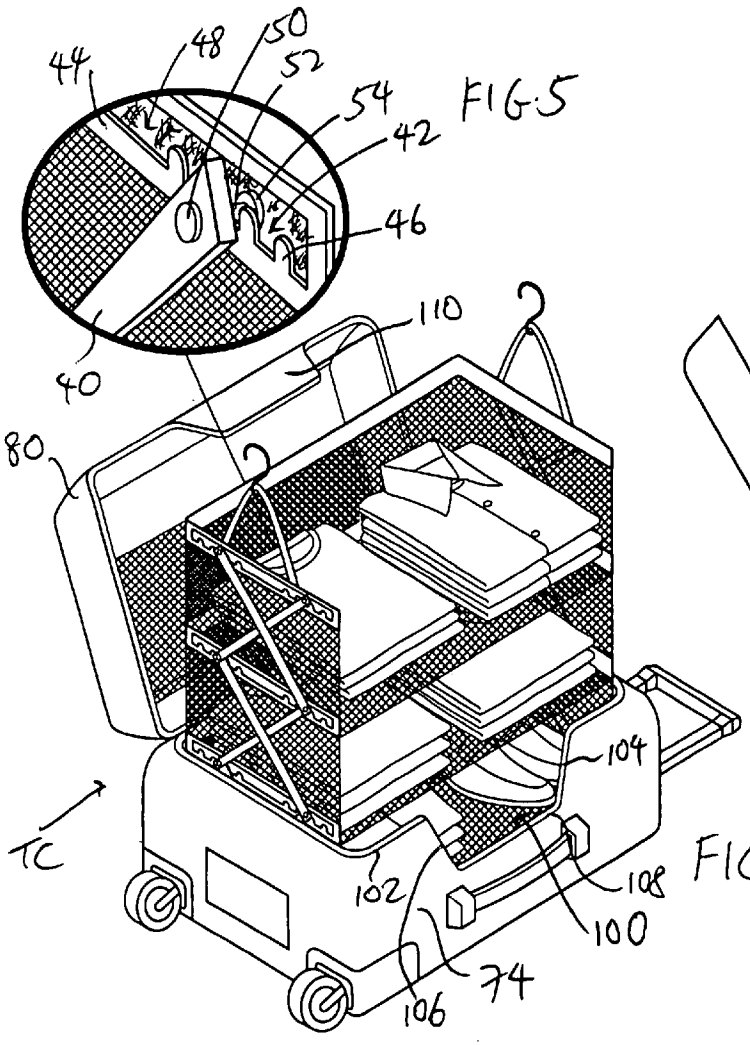
FIG. 5
FIG. 12

94
96
92
86
76
78
90
74
72
84
82
80
70
TC

PORTABLE ORGANIZER FOR USE WITH LUGGAGE

BACKGROUND OF THE INVENTION

1. Field of the Invention

The present invention relates generally to organizers that are used for clothing, and in particular, to a portable organizer that can be used with a travel case and removed therefrom to be hung in a closet.

2. Description of the Prior Art

For travelers, it is, of course, well known to utilize a travel bag, such as a suitcase, a garment bag or the like, for carrying articles, such as clothing, while traveling. It is also well known in the prior art to provide inserts or the like for suitcases and garment bags which protect clothing or other articles carried within the travel bag even more effectively than does the case itself.

It is also known in the art to provide some sort of organizer in a travel case which will separate certain articles from other articles. There are several ways this is done. Probably the most popular way is through the use of trays. Many such trays are removable from the case to provide access to the rest of the case or bag.

Other methods for separating articles in travel bags include pockets and divider assemblies.

SUMMARY OF THE DISCLOSURE

One objective of the present invention is to provide an organizer for a travel bag or case which separates and keeps clothing and other articles neatly arranged by employing dividers, and which is convenient for use.

To accomplish the objectives set forth above, the present invention provides a travel case assembly that has a travel case having a plurality of walls defining an enclosed storage space, and an organizer positioned inside the storage space. The organizer includes an enclosing netted fabric wall and netted fabric shelves that define at least one storage compartment, and a collapsible support system supporting and defining the netted fabric wall and netted fabric shelves so that (i) the compartments can be expanded when the shelves are separated from each other, and (ii) the shelves can be stacked into a compressed position.

BRIEF DESCRIPTION OF THE DRAWINGS

FIG. 1 is a perspective view of an organizer according to one embodiment of the present invention shown in an open or expanded position.

FIG. 2 is a perspective view of the organizer of FIG. 1 shown in a closed or compressed position.

FIG. 3 is a side plan view of the organizer of FIG. 1 shown in an open or expanded position.

FIG. 4 is a side plan view of the organizer of FIG. 1 shown in a closed or compressed position.

FIG. 5 is an enlarged view of an end of an X-bar showing how its pin is seated in a slot inside a frame member.

FIGS. 7 and 8 are exploded side plan views illustrating the organizer of FIG. 1 in use with different-sized travel cases.

FIG. 12 is a perspective view of a travel case according to one embodiment of the present invention shown in use with the organizer of FIG. 1.

DETAILED DESCRIPTION OF THE PREFERRED EMBODIMENTS

Figure 7:
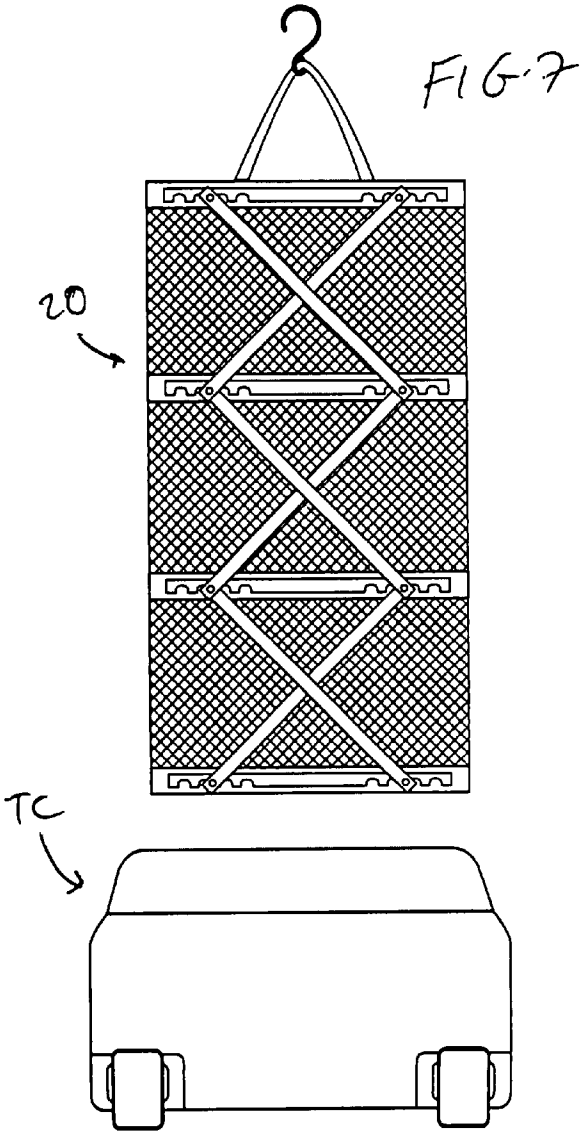

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1-5 illustrate an organizer 20 according to the present invention that can be used with travel cases or travel bags. The organizer 20 has a plurality of compartments 22 that are defined by an enclosing netted fabric wall and netted fabric shelves 24, with a collapsible support system supporting and defining the netted fabric wall.

The enclosing netted fabric wall has three walls, a first side wall 28, a second side wall 30, and a rear wall 32 connecting the side walls 28, 30. There is no front wall as the front is opened for access to the compartments 22. These three walls 28, 30, 32 define an enclosed storage space, and a plurality of shelves 24 are provided in this enclosed storage space to define separate compartments 22. In FIGS. 1-4, the organizer 20 is shown as having three shelves 24 and three compartments 22, although any number of desired shelves 24 and compartments 22 can be provided. Each shelf 24 can be stitched via its side edges and its rear edge to inner sides of the corresponding locations of the walls 28, 30, 32. A border 34 extends along the walls 28, 30, 32 at the locations of each shelf 24.

The collapsible support system includes a plurality of pairs of pivoting X-bars 40 that are adapted to be adjustably fitted into selected slots 42 of corresponding connector sections 44 of the borders 34. The borders 34 and the bars 40 can be provided in the form of a lightweight metal, such as steel or aluminum. As best shown in FIGS. 3 and 5, one connector section 44 is provided along the outer side of each border 34 along the side walls 28 and 30. Each connector section 44 has an elongated interior opening 48 with a plurality of slots 42 that are defined in the opening 48 by ridges 46 There is a top border 34 that does not need a fabric shelf 24, so the embodiment shown in FIGS. 1-4 has four borders 34 and three shelves 24 to define three compartments 22. A pair of pivoting X-bars 40 is provided between each connector section 44 on each side wall 28 and 30. Each pair of pivoting X-bars 40 is pivotally coupled at about its center so that the two bars in each pair of X-bars 40 can be pivoted in a scissor-like manner with respect to each other. Each end of each bar has a pin 52 that has enlarged ends 50 and 54 at opposite ends of the pin 52. The end 50 secures the pin 52 to the bar, and the end 54 is free and unattached, but can be used to lodge into a selected slot 42 to secure the pin 52 in the chosen slot 42.

FIG. 5 shows a pin 52 coupled to the upper end of the upper-most X-bars at the upper-most border 34*c* (see FIG. 3), so the pin 52 is shown as extending through one X-bar. For the pivoting connections in the two middle borders (34*a* and 34*b* in FIGS. 1-3), one pin 52 extends through the lower end of an upper X-bar, and the upper end of a lower X-bar, so that the one pin 52 essentially couples and pivots the ends of two different X-bars. The lower-most border 34*d* is similar to the upper-most border 34*c* in that a pin 52 is coupled to the lower end of the lower-most X-bars.

Each pin 52 is adapted to be seated inside a slot 42, so that the height of each compartment 22 can be adjusted by seating the pins 52 of the corresponding X-bars 40 (on each side wall 28, 30) for that compartment 22 in the desired slots 42. The X-bars 40 pivot so that they can be adjusted from a compressed or closed position (as shown in FIGS. 2 and 4) where the pins 52 occupy slots 42 that are furthest away from each other along the same connector section 44, to a fully expanded or opened position where the pins 52 occupy slots 42 that are closest to each other along the same connector section 44. In the expanded or open position, the X-bars 40 function to provide the structural support needed to keep the enclosing netted fabric wall open so that the compartments 22 are open.

Figure 6:
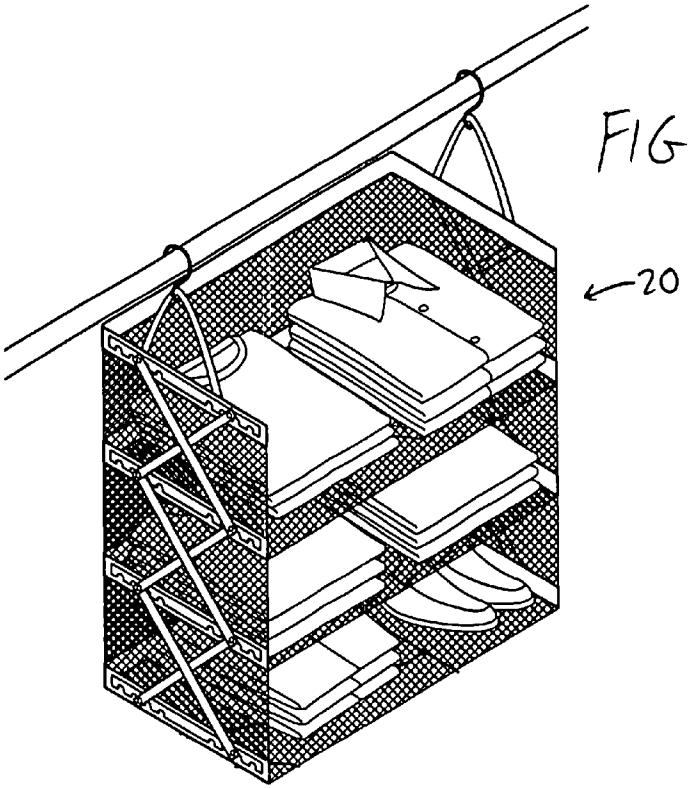
FIG. 6 illustrates the organizer of FIG. 1 shown hanging from a bar in a closet.

There are two sets of supports (i.e., connector sections 44 and pairs of X-bars 40) for the organizer 20, with one set of supports along each side wall 28 and 30. In addition, a handle 60 extends from the top border 34 of each side wall 28, 30, and a hook 62 can be provided with each handle 60. As a result, the organizer 20 can be lifted directly from a travel case (e.g., a suitcase) and then hung from a hanging bar in a closet, as shown in FIG. 6. When the organizer 20 is hung in a closet, the collapsible support system allows the compartments 22 to be expanded to function like shelves in a closet. In this embodiment, the organizer 20 can be used independently from any luggage as a clothing organizer that can be hung in any closet. When the organizer 20 is to be placed back into a travel case TC, the collapsible support system allows the shelves 24 (and the contents in the compartments 22) to stack into a compressed position (see FIG. 2), so that the travel case TC can be closed.

The organizer 20 allows the user to pack or organize different items (clothing and non-clothing) on different shelves 24. The organizer 20 (with the items in the compartments 22) can be easily moved from one location to another by lifting the entire organizer 20, and then hanging the organizer 20 in a different closet, or placing the organizer 20 inside a travel case.

Referring to FIG. 7, the organizer 20 can be sized and configured to occupy the entire interior space of a specific travel case TC. For example, the lengths of the four sides of the organizer 20 can be sized to be almost the same as the lengths of the interior of the four walls of the travel case TC. As an alternative, the organizer 20 can be sized and configured to occupy a portion of, but not all of, the interior space of a travel case TC, as shown in FIG. 8. This allows for the user to have different options for packing. For example, in FIG. 8, the user can use the organizer 20 with a larger travel case TC and have extra room for packing boxes or boxed-sized objects.

Figures 9, 10, 11:
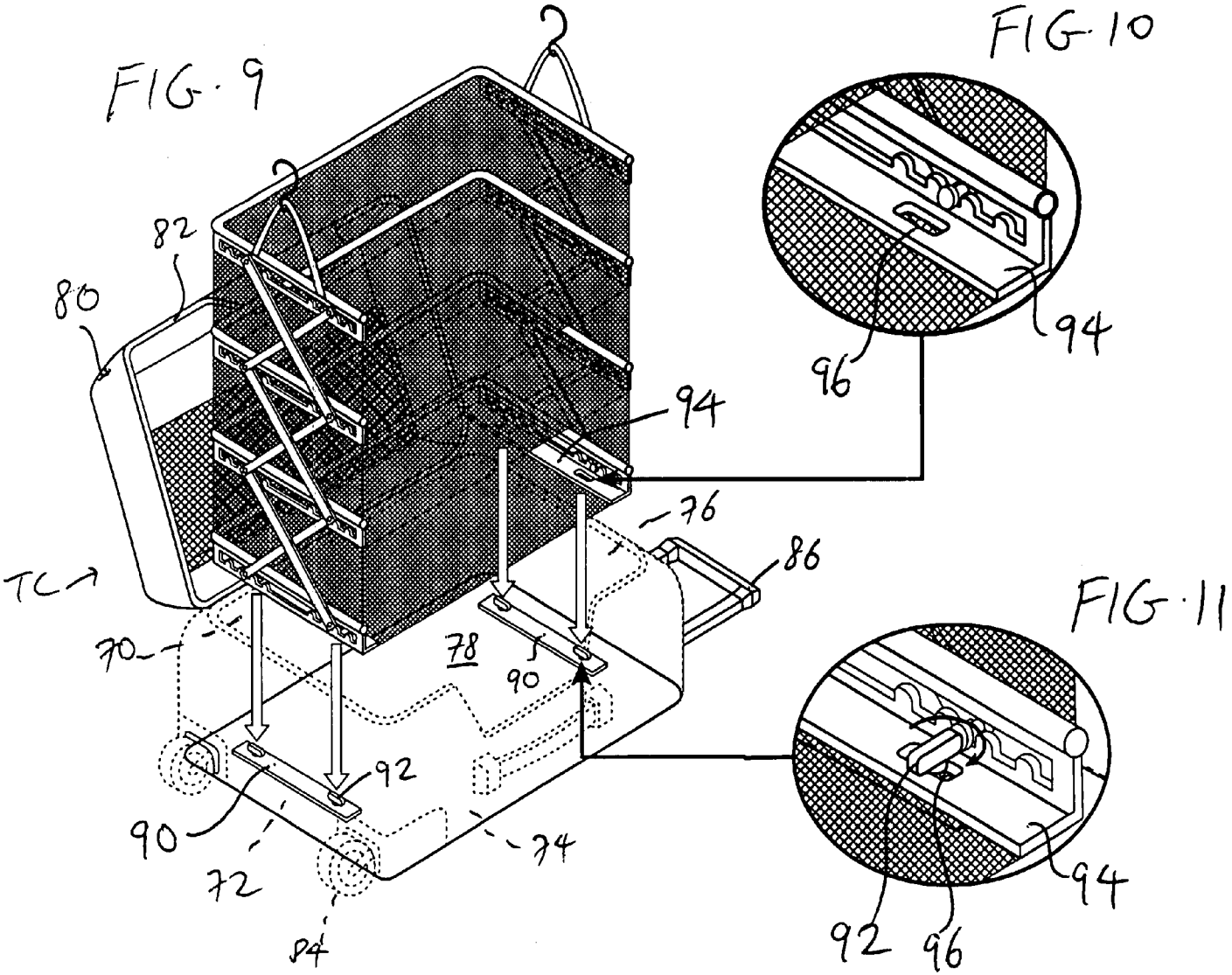
FIG. 9 is an exploded perspective view of the organizer of FIG. 1 shown removably secured to a travel case.
FIG. 10 is an enlarged view of a portion of a plate support on the organizer.
FIG. 11 is an enlarged view showing the plate support of FIG. 10 secured to a plate support on the travel case.

In FIGS. 1-8, the organizer 20 is shown and described as being removable from the interior of the travel case TC. However, it is also possible to secure the organizer 20 to a fixed position inside the travel case TC so that the organizer 20 and its contents do not shift when the travel case TC is moved from one location to another. Referring now to FIG. 9, the same organizer 20 can be removably secured to the interior of a travel case TC. The travel case TC can be any conventional travel case or bag having a main body section with an interior storage space that is defined four side walls 70, 72, 74 and 76 and a rear wall 78. A lid 80 covers the top of the storage space, and the lid 80 can have a peripheral flange 82 with a zipper connecting the edges of the flange 82 with the top edges of the side walls 70, 72, 74, 76. The travel case TC can also have rollers or wheels 84, retractable handles 86 and other features normally found in conventional travel cases.

As best shown in FIGS. 9-11, the organizer 20 can be secured to support plates 90 that are secured to the base of the travel case TC in the interior storage space, such as by rivets or screws. Two support plates 90 are provided at opposite ends or sides of the base of the travel case TC, and each support plate 90 has two opposing pivoting wings 92. The bottom shelf 24 of the organizer 20 has two corresponding support plates 94 that are positioned to be aligned with the support plates 90. Each of the support plates 94 has two opposite elongated slots 96 that are aligned with, and adapted to receive, a separate wing 92. The organizer 20 can be secured inside the travel case TC by seating the bottom shelf 24 on to the base, and then inserting the wings 92 through the corresponding slots 96, and then turning the wings 92, as shown in FIGS. 9-11. With the organizer 20 secured to the base of the travel case TC, the user can place the travel case TC on the floor of a closet, open the lid 80, lift up the hooks 62 to raise the organizer 20, and then hang the hooks 62 from a bar in the closet. The organizer 20 will then be expanded and ready for use, and the user would not even need to remove the organizer 20 from the travel case TC as the organizer 20 secured to the base of the travel case TC. To remove the organizer 20 from the travel case TC, the user simply turns the wings 92 so that they are aligned with the slots 96, thereby allowing them to be removed through the slots 96.

In addition to the above embodiments, the present invention also provides a unique travel case TC that can be used in connection with any of the organizers 20 described herein. Referring to FIG. 12, the travel case TC can be provided with a cut-out space 100 in the front wall 74. The cut-out space 100 is cut from the top edge 102 of the front wall 70, and has two side edges 104, 106 (which can be straight or angled) extending downwardly from the top edge 102 to connect to a lower edge 108. As best shown in FIG. 12, this cut-out space 100 provides the user with access to the contents in the lower shelves 24 of the organizer 20 through the front wall 70, so that the organizer 20 does not need to be removed from the travel case TC for the user to access those contents in the lower shelves 24. As such, the user can use the organizer 20 directly from the travel case TC (see FIG. 12) without even removing the organizer 20. A flap piece 110 is provided from the flange 82 of the lid 80, and is sized and configured to occupy the cut-out space 100 when the lid 80 is closed. In one embodiment, the zipper can run along the edges 102, 104, 106, 108 so that the travel case TC can be completely enclosed and sealed.

Thus, the present invention provides an organizer 20 that can be used with a travel case TC in a manner which allows for the user to spend minimal time in packing and unpacking the travel case, both at home and at a hotel or other remote location. The cut-out space 100 allows clothing and items to be accessed from within the organizer 20 without the need to remove the organizer 20 from the travel case. In addition, the support system provides support for the shelves 24 so that the entire organizer 20 can be lifted directly from the travel case TC and hung from a closet.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A travel case assembly, comprising:

a travel case having a plurality of walls defining an enclosed storage space;

an organizer positioned inside the storage space, the organizer comprising:

an enclosing netted fabric wall and a plurality of netted fabric shelves that define at least two storage compartments; and a collapsible support system supporting and defining the netted fabric wall and netted fabric shelves so that (i) the compartments can be expanded when the shelves are separated from each other, and (ii) the shelves can be stacked into a compressed position, wherein the collapsible support system includes:

a plurality of connector sections, each connector section positioned at the netted fabric wall at the location of a shelf, each connector section having an elongated opening; and a plurality of pivoting X-bars, each X-bar having an end that has a pin that has enlarged ends at opposite ends of the pin, with one of enlarged ends being free and adapted to be moved within the elongated opening of a corresponding connector section to allow the pivoting X-bars to be pivoted so that the shelves can be moved towards and away from each other, and wherein each elongated opening of each connector section has a plurality of slots, with the free end of the pin lodged into a selected slot to secure the pin in the chosen position.

2. The assembly of claim 1, wherein the plurality of walls for the travel case has four side walls that includes a front wall, the travel case further including a lid that covers the top of the storage space, the lid having a peripheral flange with a zipper connecting the edges of the flange with top edges of the side walls, wherein the front wall has a cut-out space that is cut from the top edge of the front wall, and has two side edges extending downwardly from the top edge of the front wall to connect to a lower edge.

3. The assembly of claim 2, wherein a flap piece is provided from the flange of the lid, and is sized and configured to occupy the cut-out space when the lid is closed.

4. The assembly of claim 1, wherein the netted fabric shelves of the organizer includes a bottom shelf which has at two support plates positioned at opposite sides thereof, with each opposing support plate having an elongated slot, and wherein two support plates are provided at opposite sides of the travel case inside the storage space, and each support plate of the travel case has a pivoting wing, with each wing adapted to be inserted through a corresponding slot in each supporting plate of the organizer.

5. The assembly of claim 1, wherein the organizer is sized to fill the entire storage space when the organizer is filled with items and placed inside the storage space.

6. The assembly of claim 1, wherein the organizer is sized to fill a portion of the storage space when the organizer is filled with items and placed inside the storage space.

7. The assembly of claim 1, wherein the shelves of the organizer are compressed towards each other when the organizer is positioned inside the travel case with the lid closed.

8. The assembly of claim 1, wherein the shelves of the organizer are opened away from each other to define storage compartments when the organizer is suspended from a bar.

9. The assembly of claim 1, wherein the collapsible support system includes:

a plurality of borders, each border extending around the netted fabric wall at the location of a shelf, each border having at least one connector section positioned thereon.

10. The assembly of claim 9, wherein the borders and the X-bars bars are provided in the form of a lightweight metal.

* * * * *